US008590183B2

(12) United States Patent
Fuller et al.

(10) Patent No.: US 8,590,183 B2
(45) Date of Patent: Nov. 26, 2013

(54) FLUID VORTEX DISPLAY DEVICE

(75) Inventors: Mark W. Fuller, Toluca Lake, CA (US); Michael Jason Baldwin, Los Angeles, CA (US); Riae Yoo, Glendale, CA (US)

(73) Assignee: WET Enterprises, Inc., Sun Valley, CA (US)

( * ) Notice: Subject to any disclaimer, the term of this patent is extended or adjusted under 35 U.S.C. 154(b) by 44 days.

(21) Appl. No.: 12/970,801

(22) Filed: Dec. 16, 2010

(65) Prior Publication Data

US 2011/0138661 A1 Jun. 16, 2011

Related U.S. Application Data

(60) Provisional application No. 61/287,177, filed on Dec. 16, 2009.

(51) Int. Cl.
*G09F 19/00* (2006.01)

(52) U.S. Cl.
USPC ..... 40/406

(58) Field of Classification Search
USPC ..... 40/406, 407, 409; 239/20, 211, 18, 239/17; 446/267
See application file for complete search history.

(56) References Cited

U.S. PATENT DOCUMENTS

| | | | | |
|---|---|---|---|---|
| 1,080,340 | A * | 12/1913 | Heissenbuttel | 40/407 |
| 5,174,239 | A * | 12/1992 | Sato | 119/249 |
| 5,381,956 | A * | 1/1995 | Robinson et al. | 239/22 |
| 6,393,192 | B1 * | 5/2002 | Koren | 385/147 |
| 6,921,023 | B1 * | 7/2005 | Bright et al. | 239/17 |
| 7,245,561 | B2 | 7/2007 | Coleman | |
| 7,302,767 | B2 * | 12/2007 | McKnight | 40/409 |

* cited by examiner

*Primary Examiner* — Joanne Silbermann
*Assistant Examiner* — Kristina Junge
(74) *Attorney, Agent, or Firm* — Blakely Sokoloff Taylor & Zafman LLP

(57) ABSTRACT

A fluid vortex display device includes a cylindrical vessel sealed at an upper end. A first fluid inlet is coupled to the cylindrical vessel adjacent a lower end of the vessel and directed at a substantial angle to an outer circumference of the cylindrical vessel. A discharge outlet of a pump is coupled to the fluid inlet. A closure is coupled to the lower end of the vessel. The closure includes a fluid outlet that is substantially spaced apart from a central longitudinal axis of the vessel. The closure may project into the cylindrical vessel to create an annular space adjacent the fluid inlet. The fluid outlet may be in the upper surface of the closure, which may not be perpendicular to the central longitudinal axis of the vessel. A support stand may support the vessel such that it is not perpendicular to a level foundation surface.

9 Claims, 4 Drawing Sheets

FLUID VORTEX DISPLAY DEVICE

CROSS REFERENCE TO RELATED APPLICATIONS

This application claims the benefit pursuant to 35 U.S.C. 119(e) of U.S. Provisional Application No. 61/287,177, filed Dec. 16, 2009, which application is specifically incorporated herein, in its entirety, by reference.

BACKGROUND

1. Field

Embodiments of the invention relate to the field of fluid displays; and more specifically, to fluid vortex displays.

2. Background

Water features such as ornamental fountains may be provided as dramatic focal points for sites such as hotels, amusement parks, and shopping centers. Such water features may provide a unique visual symbol that becomes associated with the site where they are located. It would be desirable to create a water feature that provides a striking and memorable appearance that is distinctly different from other water features for use as a unique visual symbol.

SUMMARY

A fluid vortex display device includes a cylindrical vessel sealed at an upper end. A first fluid inlet is coupled to the cylindrical vessel adjacent a lower end of the vessel and directed at a substantial angle to an outer circumference of the cylindrical vessel. A discharge outlet of a pump is coupled to the fluid inlet. A closure is coupled to the lower end of the vessel. The closure includes a fluid outlet that is substantially spaced apart from a central longitudinal axis of the vessel. The closure may project into the cylindrical vessel to create an annular space adjacent the fluid inlet. The fluid outlet may be in the upper surface of the closure, which may not be perpendicular to the central longitudinal axis of the vessel. A support stand may support the vessel such that it is not perpendicular to a level foundation surface.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

Figure 1:
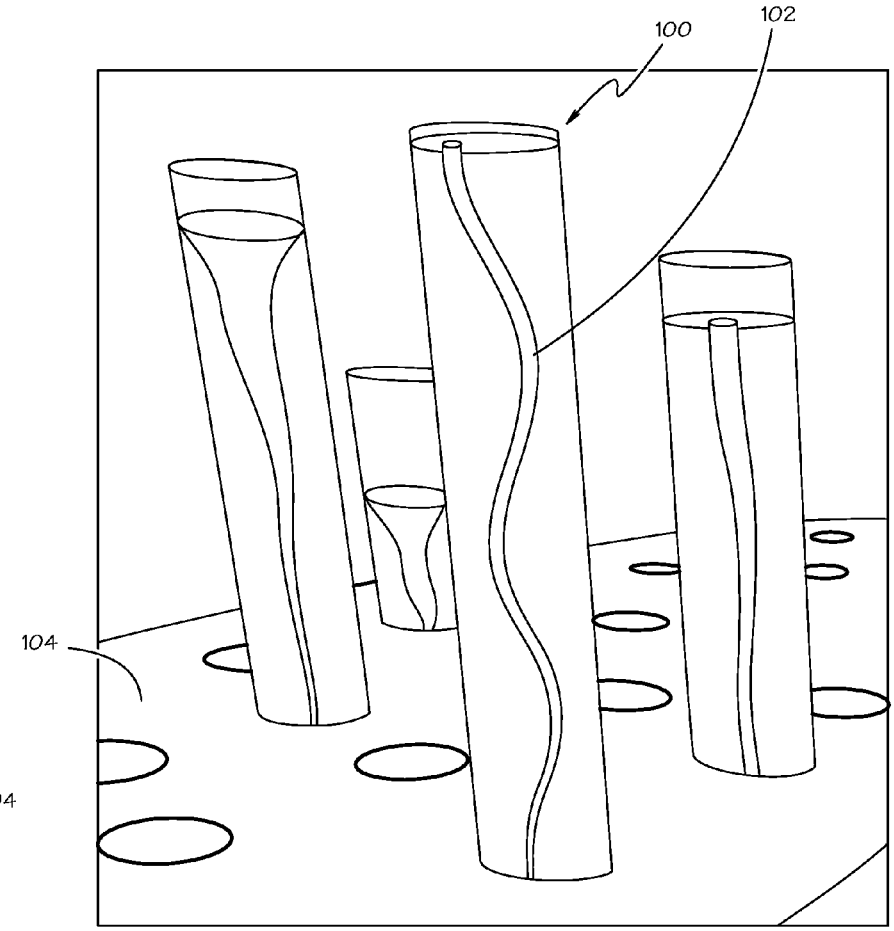
FIG. 1 is a pictorial view of a number of fluid vortex display devices displayed above a floor as may be provided by the invention.

FIG. 1 shows a pictorial view of a number of fluid vortex display devices 100 displayed above a floor 104 as may be provided by the invention. Each fluid vortex display device contains fluid that rotates and drains to create a fluid vortex, a spinning, often turbulent, flow of fluid. Any spiral motion with closed streamlines is vortex flow. The motion of the fluid swirling rapidly around a center is called a vortex. The speed and rate of rotation of the fluid are greatest at the center, and decrease progressively with distance from the center. The fluid vortex display device 100 may be arranged to create conditions that cause the center of the vortex to take on a sinuous shape as shown.

Each fluid vortex display device may be substantial in size. For example, in a display of the type illustrated, the fluid vortex display devices 100 may be 12 to 24 inches in diameter and perhaps 4 to 10 feet tall. Of course, fluid vortex display devices of significantly different sizes may also be produced according to the invention.

Figure 2:
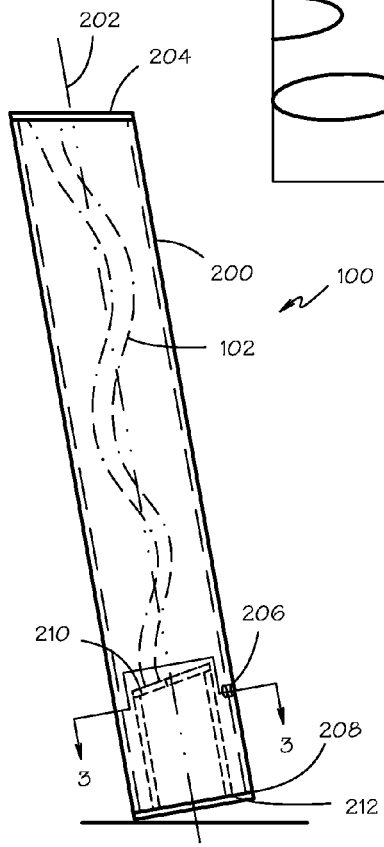
FIG. 2 is a side elevation of fluid vortex display device.

FIG. 2 is a side elevation of fluid vortex display device 100. The device includes a cylindrical vessel 200 having a central longitudinal axis 202. For example, the cylindrical vessel may include a clear acrylic tube which may have walls approximately 1 inch thick for the size of device illustrated. The vessel is sealed at an upper end 204. The top of an acrylic tube may be capped to give the illusion that the tube is one solid piece. The tube is not open to the elements and a vortex created within the vessel will be a completely enclosed, variable height vortex.

A first fluid inlet 206 is coupled to the cylindrical vessel 200 adjacent a lower end 208 of the vessel opposite the upper end of the vessel 204. A discharge outlet of a pump may be coupled to the first fluid inlet of the cylindrical vessel to supply fluid to the vessel. The lower end 208 of the vessel 200 is closed and a fluid outlet 210 is provided at the lower end of the vessel to allow fluid to drain freely from the vessel.

Figure 3:
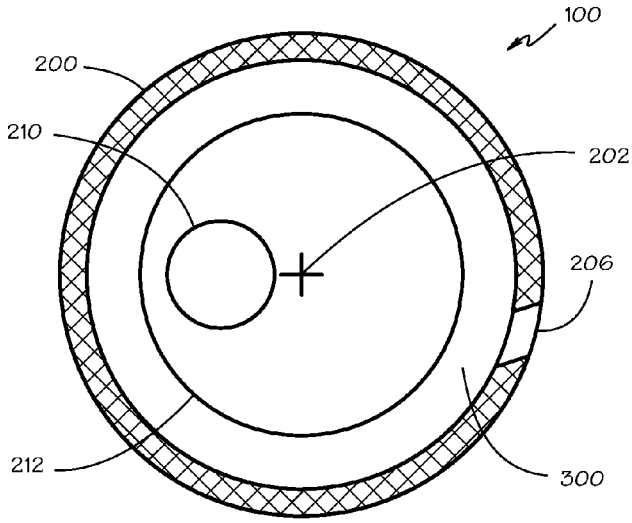
FIG. 3 is a cross-section of the fluid vortex display device taken along section line 3-3 of FIG. 2.

FIG. 3 is a cross-section of the fluid vortex display device 100 taken along section line 3-3 of FIG. 2. The first fluid inlet 206 is directed at a substantial angle to an outer circumference of the cylindrical vessel 200. The first fluid inlet 206 may be directed on a first plane that is substantially perpendicular to the central longitudinal axis. The first fluid inlet 206 is directed to impart rotation of the fluid within the cylindrical vessel 200. The fluid outlet 210 is substantially spaced apart from the central longitudinal axis 202 of the vessel 200. The placement of the fluid outlet 210 may contribute to an instability of the vortex 102 and cause the vortex to assume interesting and changing forms.

Referring again to FIG. 2, the lower end 208 of the cylindrical vessel 200 may be closed by a closure 212 in the form of a "top hat" that projects into the cylindrical vessel. The sides of the top hat closure 212 form an annular space 300 adjacent the first fluid inlet 206. For devices of the size illustrated, the outer diameter of the top hat closure 212 may be roughly four inches less than the inner diameter of the cylindrical vessel 200. The annular space 300 may help to induce a rotational flow in the fluid within the cylindrical vessel 200.

Figure 4:
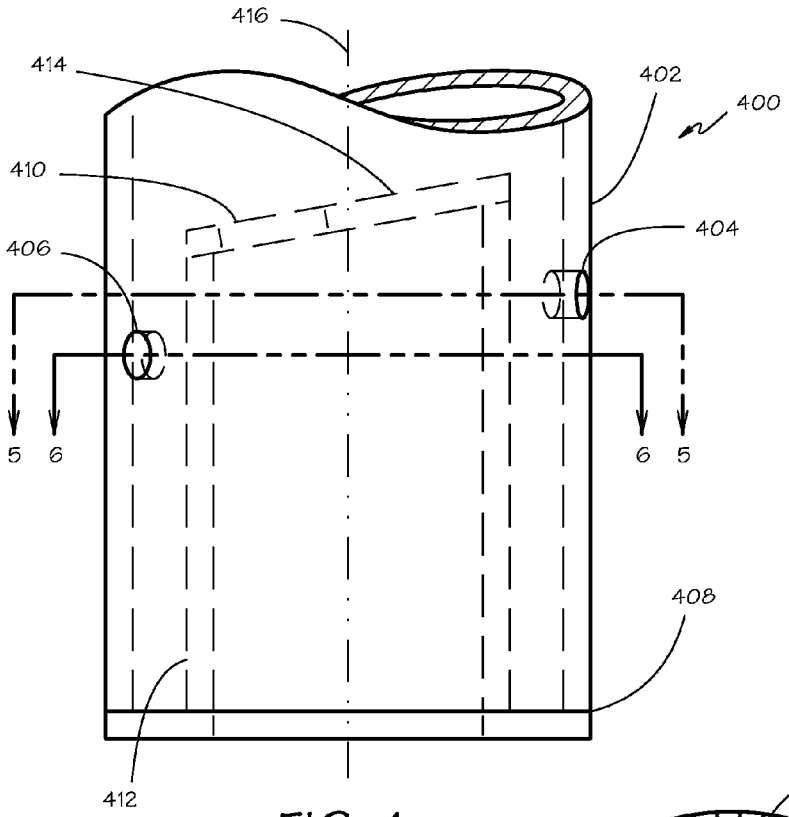
FIG. 4 is a side elevation of a bottom portion of another fluid vortex display device.

FIG. 4 is a side elevation of a bottom portion of another fluid vortex display device 400. As in the device 100 described above, the lower end 408 of a cylindrical vessel 402 may be closed by a closure 412 in the form of a "top hat" that projects into the cylindrical vessel. The closure 412 includes an upper surface 414 that intersects the central longitudinal axis 416 of the vessel 402. The fluid outlet 410 is in the upper surface 414. The upper surface 414 of the closure 412 may not be perpendicular to the central longitudinal axis 416 of the vessel 402. Placing the upper surface at an angle to the central longitudinal axis 416 may contribute to an instability of the vortex 102 and cause the vortex to assume interesting and changing forms.

The fluid vortex display device 400 may have first and second fluid inlets 404, 406 coupled to the cylindrical vessel 402 adjacent the lower end 408 of the vessel. The second fluid inlet 406 may be directed at a second substantial angle to the outer circumference of the cylindrical vessel 402.

The first and second fluid inlets 404, 406 may be directed such that fluid introduced through the first and second fluid inlets induces rotation of fluid within the vessel 402 in a same direction. The first and second fluid inlets 404, 406 may or may not be directed along the same plane. In the device 400 illustrated, the first and second fluid inlets 404, 406 are directed along different planes.

Figure 5:
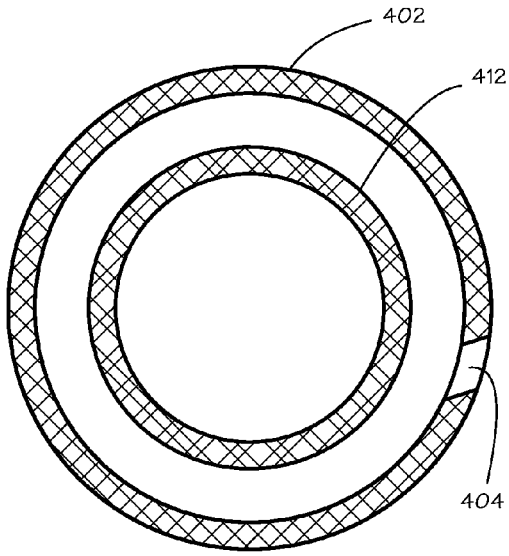
FIG. 5 is a cross-section of the fluid vortex display device taken along section line 5-5 of FIG. 4.
Figure 6:
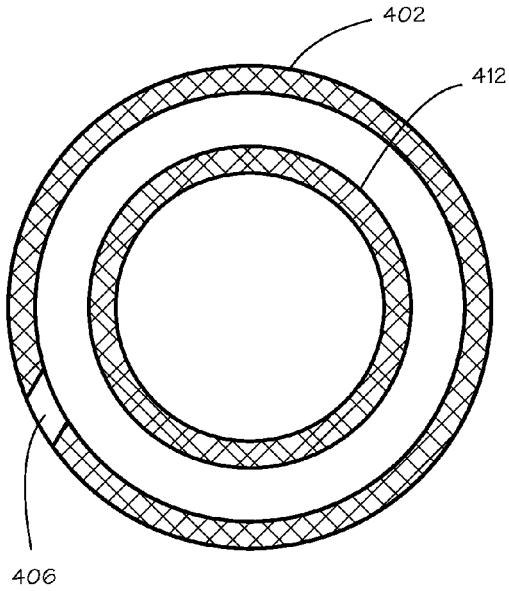
FIG. 6 is a cross-section of the fluid vortex display device taken along section line 6-6 of FIG. 4.

FIGS. 5 and 6 are cross-sections of the fluid vortex display device 400 taken along section lines 5-5 and 6-6 of FIG. 4. The arrangement of the first and second fluid inlets 404, 406 being directed at a substantial angle to the outer circumference of the cylindrical vessel 402 may be more clearly seen in these views.

Figure 7:
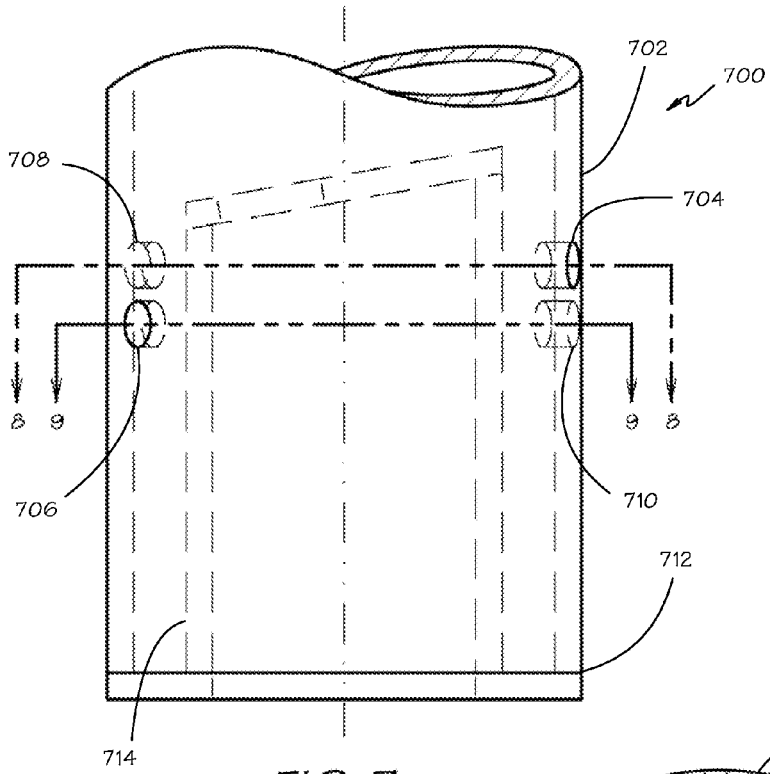
FIG. 7 is a side elevation of a bottom portion of yet another fluid vortex display device.

FIG. 7 is a side elevation of a bottom portion of yet another fluid vortex display device 700. The fluid vortex display device 700 may have first and second fluid inlets 704, 708 coupled to the cylindrical vessel 702 adjacent the lower end 712 of the vessel. The second fluid inlet 708 may be directed at a second substantial angle to the outer circumference of the cylindrical vessel 702. The first and second fluid inlets 704, 708 may be directed such that fluid introduced through the first inlet 704 induces rotation of fluid within the vessel 702 in a first direction and fluid introduced through the second inlet 708 induces rotation of fluid within the vessel in a second direction opposite the first direction. The first and second fluid inlets 704, 708 may be coupled to two different pumps so that the pumps may be alternately energized to induce rotation of the fluid in either the first or the second direction.

Figure 8:
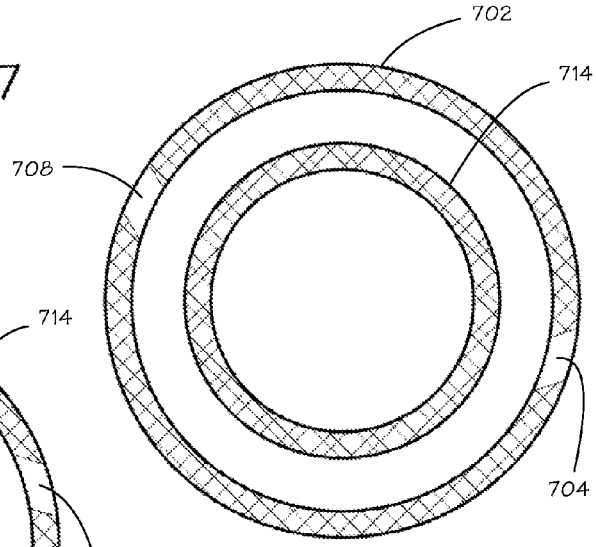
FIG. 8 is a cross-section of the fluid vortex display device taken along section line 8-8 of FIG. 7.
Figure 9:
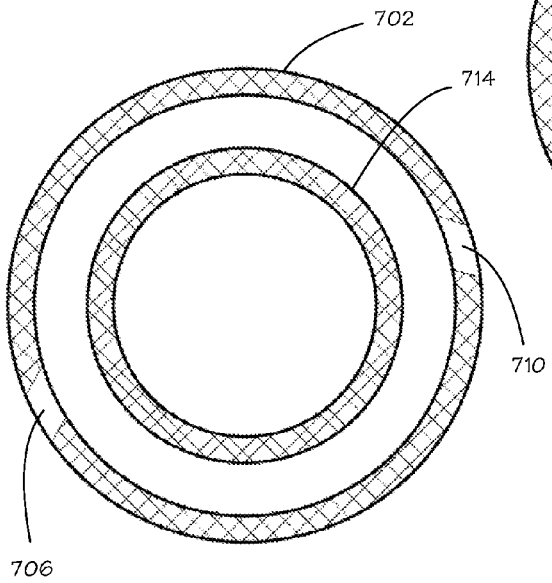
FIG. 9 is a cross-section of the fluid vortex display device taken along section line 9-9 of FIG. 7.

FIGS. 8 and 9 are cross-sections of the fluid vortex display device 700 taken along section lines 8-8 and 9-9 of FIG. 7. The arrangement of the first and second fluid inlets 704, 708 being directed at a substantial angle to the outer circumference of the cylindrical vessel 702 may be more clearly seen in these views. Further, the fluid vortex display device 700 may include third and fourth fluid inlets 706, 710 that operate cooperatively with the first and second fluid inlets 704, 708 such that two of the four inlets may direct fluid into the vessel 700 to induce rotation of the fluid in one of the first or second directions.

Figure 10:
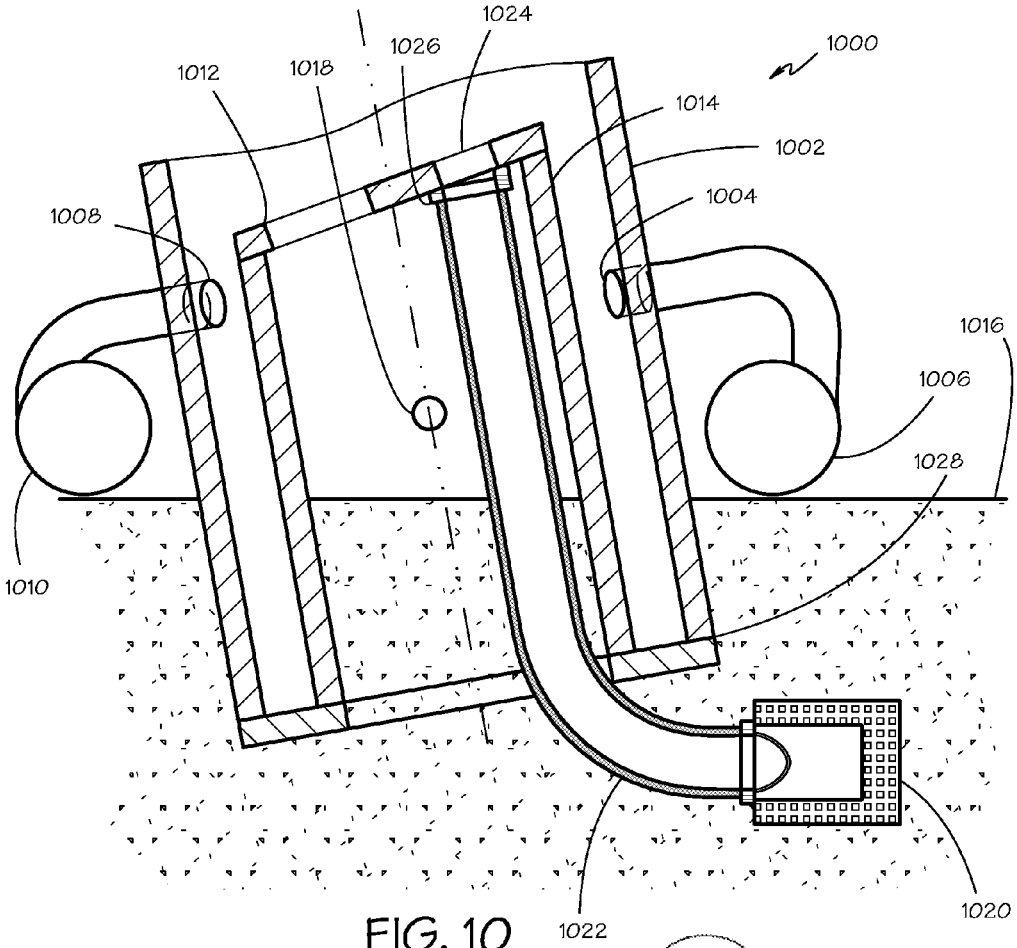
FIG. 10 is a side elevation of a bottom portion of still another fluid vortex display device.

FIG. 10 is a side elevation of a bottom portion of still another fluid vortex display device 1000. First and second fluid inlets 1004, 1008 may be directed such that fluid introduced through the first inlet 1004 induces rotation of fluid within the vessel 1002 in a first direction and fluid introduced through the second inlet 1008 induces rotation of fluid within the vessel in a second direction opposite the first direction. The first and second fluid inlets 1004, 1008 may be coupled to two different pumps 1006, 1010 so that the pumps may be alternately energized to induce rotation of the fluid in either the first or the second direction.

The fluid vortex display device 1000 may include a light source 1020 that emits light into the vessel 1002 from the upper surface 1024 of the closure 1014. The light source 1020 may include a flexible, fluid filled light pipe 1022 having an end 1026 connected to the upper surface 1024 of the closure 1014.

The lower end 1028 of the vessel 1002 may be immersed in a fluid pond 1016 such that fluid which drains through the fluid outlet 1012 collects in the pond. The light source 1020 may be a submersible lamp that is located in the pond. The pumps 1006, 1010 may be submersible pumps that are located in the pond or they may have inlets that draw fluid from the pond. The closure device 1014 may include an air vent 1018 so that the fluid outlet 1012 will drain into an air space.

Figure 11:
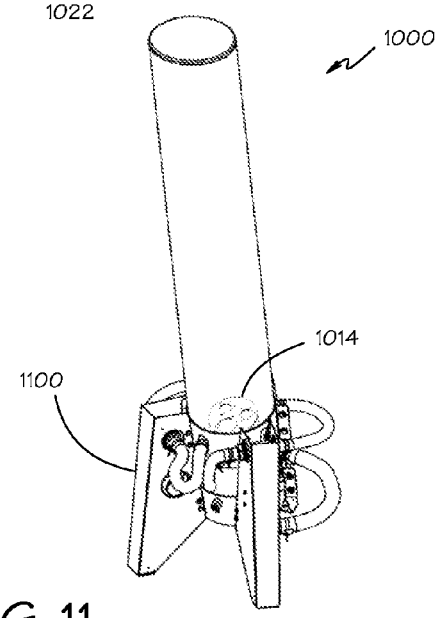
FIG. 11 is a pictorial view of the fluid vortex display device shown in FIG. 10.

FIG. 11 is a pictorial view of the fluid vortex display device 1000. A support stand 1100 may be coupled to a level foundation surface and to the cylindrical vessel such that the vessel is supported with the central longitudinal axis not perpendicular to the level foundation surface.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. A fluid vortex display device comprising:

a cylindrical vessel having a central longitudinal axis, the vessel being sealed at an upper end;

a first fluid inlet coupled to the cylindrical vessel adjacent a lower end of the vessel opposite the upper end of the vessel, the first fluid inlet being directed at a substantial angle through an outer circumference of the cylindrical vessel; and a closure coupled to the lower end of the vessel, the closure having an upper surface that intersects with and is not perpendicular to the central longitudinal axis of the vessel, the upper surface including a fluid outlet that is substantially spaced apart from the central longitudinal axis of the vessel.

2. The fluid vortex display device of claim 1, wherein the closure projects into the cylindrical vessel to create an annular space adjacent the lower end of the vessel and the fluid inlet.

3. The fluid vortex display device of claim 1, further comprising a light source that emits light into the vessel from the upper surface of the closure.

4. The fluid vortex display device of claim 3, wherein the light source includes a flexible, fluid filled light pipe having an end connected to the upper surface of the closure.

5. The fluid vortex display device of claim 1, wherein the first fluid inlet is directed on a first plane that is substantially perpendicular to the central longitudinal axis.

6. The fluid vortex display device of claim 1, further comprising a second fluid inlet coupled to the cylindrical vessel adjacent the lower end of the vessel opposite the upper end of the vessel, the second fluid inlet being directed at a second substantial angle through the outer circumference of the cylindrical vessel, the first and second fluid inlets directed such that fluid introduced through the first and second fluid inlets induces rotation of fluid within the vessel in a same direction.

7. The fluid vortex display device of claim 1, further comprising a second fluid inlet coupled to the cylindrical vessel adjacent the lower end of the vessel opposite the upper end of the vessel, the second fluid inlet being directed at a second substantial angle through the outer circumference of the cylindrical vessel, the first and second fluid inlets directed such that fluid introduced through the first inlet induces rotation of fluid within the vessel in a first direction and fluid introduced through the second inlet induces rotation of fluid within the vessel in a second direction opposite the first direction.

8. The fluid vortex display device of claim 1, further comprising a support stand coupled to a level foundation surface and to the cylindrical vessel such that the vessel is supported with the central longitudinal axis not perpendicular to the level foundation surface.

9. The fluid vortex display device of claim 1, further comprising a pump having a discharge outlet coupled to the first fluid inlet of the cylindrical vessel.

* * * * *